US005524983A

United States Patent [19]

Dittgen et al.

[11] Patent Number: 5,524,983

[45] Date of Patent: Jun. 11, 1996

[54] DELIVERY DEVICE

[75] Inventors: Bernd Dittgen, Wuppertal; Erhard Schroder, Lage-Horst, both of Germany; Georges Verberckmoes, Temse, Belgium

[73] Assignee: Ingersoll-Rand Company, Woodcliff Lake, N.J.

[21] Appl. No.: 362,332

[22] Filed: Dec. 22, 1994

[51] Int. Cl.[6] ..... B01F 15/04

[52] U.S. Cl. ..... 366/160.4; 222/132; 222/133; 366/162.1

[58] Field of Search ..... 366/150.1, 605, 366/152.1, 152.2160.1, 160.2, 160.3, 160.4, 160.5, 162.1, 162.3; 222/132, 133, 145.1, 145.6

[56] References Cited

U.S. PATENT DOCUMENTS

| | | | |
|---|---|---|---|
| 3,794,301 | 2/1974 | Simmonds | 366/160.5 |
| 3,963,148 | 6/1976 | Proni et al. | 222/132 |
| 4,074,363 | 2/1978 | Croft | 366/162.1 |
| 4,118,799 | 10/1978 | Krueger | 366/160.4 |
| 4,132,483 | 1/1979 | Slaats et al. | 366/162.3 |
| 4,881,820 | 11/1989 | Luckhoff | 366/152.2 |
| 5,190,373 | 3/1993 | Dickson | 366/605 |

*Primary Examiner*—Robert W. Jenkins
*Attorney, Agent, or Firm*—Walter C. Vliet; Michael M. Gnibus

[57] ABSTRACT

A device for delivering at least two fluids to be mixed to a mixing device with a drive with a coupling and with one feed pump for each fluid is proposed, in which the feed pumps (10) can be coupled individually to the drive (34). The feed pumps (10) with their housings can be mounted in such a way on a rotatable bracket (12) that their coupling ends point away from the center of rotation (14) of the bracket (12) in a star-like manner. In a device in which the drive has an additional coupling running simultaneously, an additional, rotatable bracket (12) is provided, at least two feed pumps (10) being installed in a star-like manner on this additional bracket.

10 Claims, 5 Drawing Sheets

DELIVERY DEVICE

BACKGROUND OF THE INVENTION

This invention relates generally to a device for the delivery of at least two fluids to a mixing device where they are to be mixed.

For the priming and/or coating of fabricated items originating from areas such as the building of tanks, the construction of general metal structures, and also in the building of wooden structures and furniture, use is made of two-component base paints, among other materials. These paints, such as synthetic resin varnishes, are mixed as needed by combining various components/fluids such as colors and solvents, etc. So that the widest possible color spectrum can be offered and so that it is possible to prepare the widest possible variety of paint compositions, it is necessary to keep on hand an inventory of a wide variety of paints and other mixture components such as curing agents. In the conventional case, individual paint components and curing agents (e.g., isocyanates) are first conveyed by individual pumps to a metering system. Then they are mixed, and finally they are applied to the object to be coated. In the devices and systems used for this type of work, changing over from one color to another and adjusting the ratio of the feed rates is usually a laborious and time-consuming process. For example, separate feed pumps can be provided for each paint or curing component, and these pumps usually run continuously, so that the corresponding components can be supplied rapidly when needed. This leads to unnecessarily high energy costs and at the same time to considerable wear and tear on the individual pumps. This extra wear leads in turn to high repair costs and short inspection intervals.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

One of the tasks of the present invention is to create a device which operates in a more energy-conserving and cost-saving manner but which does not suffer in terms of reliability or efficiency.

A device according to the present invention accomplishes this task. Here an advantageous delivery device for delivering at least two fluids to a mixing device, where they are then mixed, is proposed; this device being provided with a single drive motor with a coupling and with a separate feed pump for each fluid; it being advisable for each pump to have a corresponding coupling and for it to be possible to couple the feed pumps to the drive individually. Thus the advantage is obtained that only a single drive can be used to operate two pumps, and this in turn makes it possible for the individual pumps to run only when they are needed; that is, a pump runs only when it is actually connected to the drive. When the feed pump not in operation is needed, the efficient way to proceed is to disconnect the drive from the first pump and then to connect it to the second one, whereupon this pump is immediately available for service. Thus, it is also possible to change from one paint component to another relatively quickly. The first pump will then no longer continue to run unnecessarily. In an advantageous elaboration of the invention, the two feed pumps with their housings are attached to a rotatable bracket in such a way that the ends with the coupling point away from the center of rotation of the bracket to form a star-like pattern. In this way the advantage is achieved that, by means of a single movement of the rotatable bracket, it is possible to move the one pump out of the position in which it was coupled to the drive and at the same time to bring the other pump into the coupling position. This saves time and helps to improve the accuracy with which the pump can be coupled to the drive. When the fluids to be mixed react chemically with each other (cure) when combined, e.g., a paint component and a curing agent, it is advisable in a further elaboration of the invention to provide two different rotatable brackets of the type described above with pumps arranged thereon, the paint component being delivered by way of the first bracket and the curing component by way of the second bracket. In yet another advantageous elaboration of the device according to the invention, up to five feed pumps are mounted on the rotatable bracket(s). These can be arranged like a revolver around the center of rotation of the bracket. Because it is possible to cover an enormous spectrum of paint blends with only five feed pumps, these five pumps will usually be all that is needed. It is also conceivable, however, in accordance with the principle of the invention, to increase or decrease the number of pumps as a function of their size and suitability. In yet another advantageous exemplary embodiment of the invention, a paint delivery system with a mixing device, the mixing device consisting of a paint manifold and a curing agent manifold for collecting the paints and the curing agents and for delivering them to a mixing tank and a static mixer, is provided, the system incorporating a device according to the invention as described above on the basis of one of the various exemplary embodiments. It can be seen that a design of the type just indicated is much less expensive, because it is not necessary to buy a large number of drives or drive motors. At the same time, the amount of energy consumed is reduced, because only one drive is used; and although there is only one drive, it will not, as a rule, consume any more energy than a normal pump drive. The device used to connect and disconnect the appropriate pumps and to move them into position are comparatively simple and require little energy to operate. They are put into operation only when they are needed. In practice, it is conventional and also efficient to change the feed pumps by hand.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
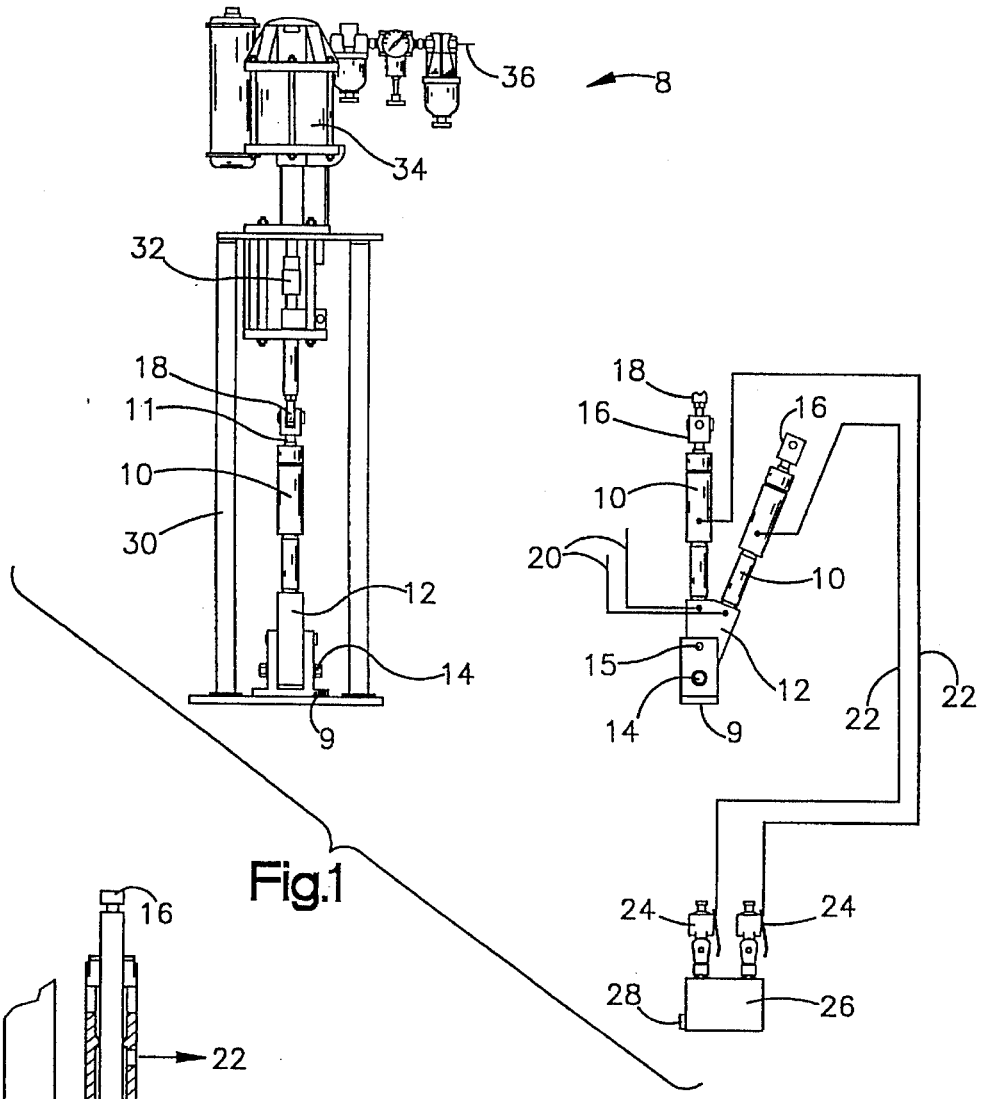
FIG. 1 shows a partial schematic diagram of a device according to the invention.

FIG. 1 shows a simplified diagram of a delivery device 8 with a frame 30, on which a drive motor 34 is mounted. Inside the frame, a feed pump 10, which is mounted in a bracket 12 so that it can turn around an axis of rotation 14, extends from top to bottom. A coupling head 16 of feed pump 10 points away from axis of rotation 14 of bracket 12 and toward drive motor 34 and is connected in a mechanically effective way to a coupling grip 18 of a drive rod 32 connected to drive motor 34.

On the right side of FIG. 1, there are two feed pumps 10, mounted in a star-like manner around a center of rotation 14 of a bracket 12; these pumps are connected by lines 20 to supply tanks (not shown) for fluids such as paint components or curing agents. In their upper half, feed pumps 10, which are designed here by way of example as double-acting reciprocating pumps, are connected by discharge lines 22 acting through valve 24 to a manifold 26. Mixture components arriving in manifold 26 leave manifold 26 through a common discharge line 28 and are then conducted to their intended destination. Feed pump 10 on the left of FIG. 1 is connected by drive rod 32 to drive motor 34, which, in the practical embodiment shown here by way of example, is a piston engine driven by compressed air. Compressed air is supplied through a compressed air line 36 to drive motor 34, the intermediate components normally used in compressed air lines such as filters, water separators, and oilers being installed along the way. A reciprocating piston located in drive motor 34 moves up and down during operation, so that piston rod 11 of feed pump 10 is moved upward by drive rod 32, in the direction away from axis of rotation 14 of bracket 12, and then back down again. Feed pump 10, used advisably in such cases, is a double-acting reciprocating pump, which conveys both when the piston is moving up and when it is moving down. On the right of FIG. 1, feed pump 10 shown on the left is oriented vertically and is shown with coupling grip 18 of drive motor 34, the grip having been broken off in the drawing. If it is now desired to pump a different fluid to manifold 26 by way of feed pump 10 on the right, which is at an angle to the first pump, drive motor 34 is stopped briefly, and left feed pump 10 is removed from the coupling position, and, in the example shown, rotated counterclockwise to the left, until coupling head 16 of right feed pump 10 engages with coupling grip 18 of drive motor 34. The coupling used here can be any type of snap-in or latch-type coupling. If the device is set up to run automatically, however, it is also possible for coupling grip 18 to be a pneumatically actuated grip which opens like a hand and grips a coupling head 16 of feed pump 10, the head being shaped, for example, like a mushroom. Couplings of this type are known to the expert, so that there is no need to describe them in detail here. When the fluid component which can be delivered by left feed pump 10 is required again for the desired mixture, drive motor 34 is stopped again. Bracket 12, which is supported in a bearing block 9 so that it can rotate about axis of rotation 14, is turned back again in a clockwise direction simply by gripping the right feed pump 10 by hand and rotating it out of the coupling position, which is shown here as the vertical position, into an adjacent position. Simultaneously, the left pump is brought back into the coupling position.

Figure 2:
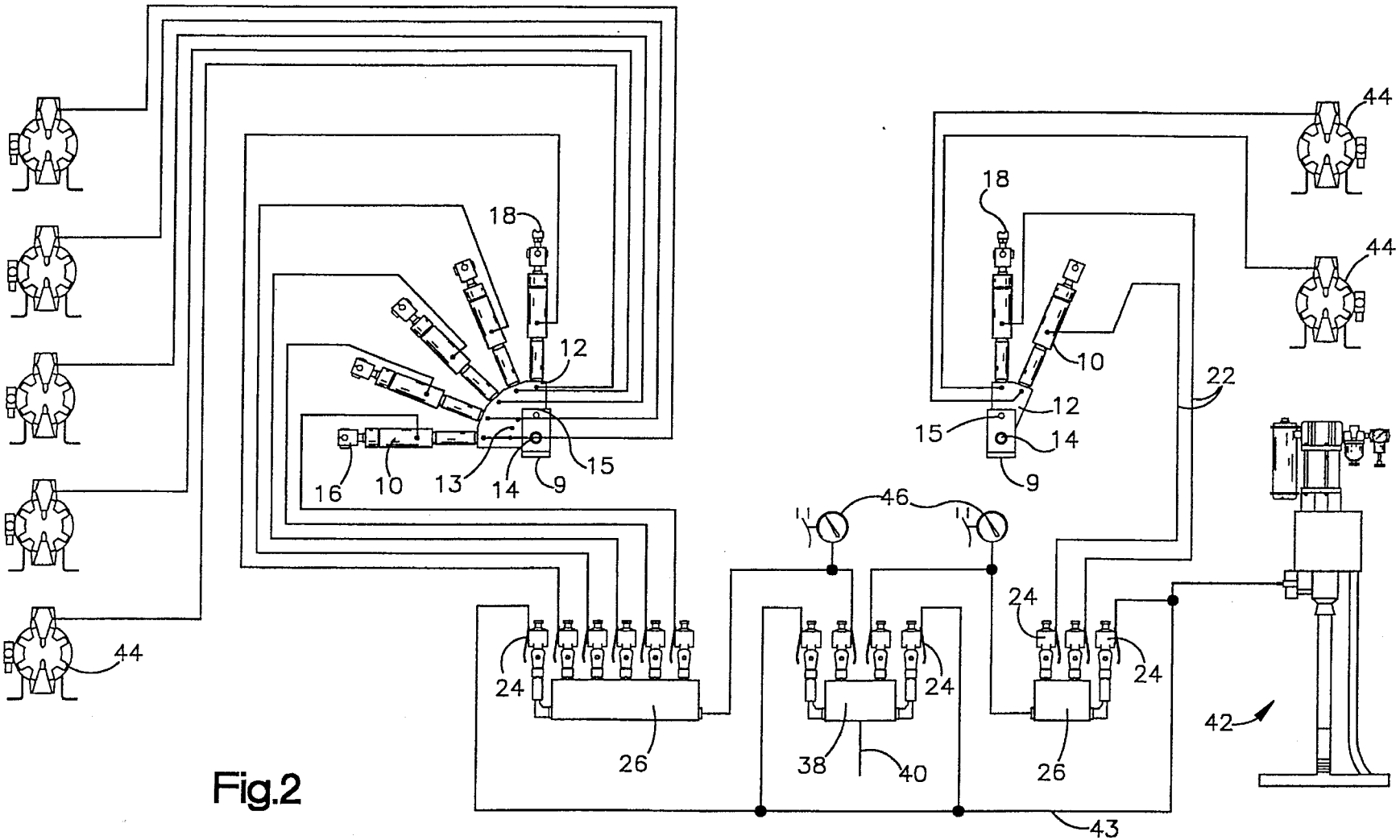
FIG. 2 shows a schematic diagram of a paint delivery and mixing system, into which the device according to FIG. 1 is integrated.

FIG. 2 shows a schematic diagram of a fluid-mixing system into which several devices according to the invention are incorporated. On the right side of FIG. 2, the assembly of a bracket 12 with two feed pumps 10 can be seen, as already described in conjunction with FIG. 1. On the left side of FIG. 2, a similar assembly is shown. Here we see a bracket 12 with five feed pumps 10, which, with their housings, are mounted in the form of a star in bracket 12; the ends of the pumps opposite coupling heads 16 are pointing toward axis of rotation 14, which is mounted in bearing block 9. Feed pump 10 in the vertical position in bracket 12 on the left side of FIG. 2 is in the coupling position and is connected to coupling grip 18 of drive rod 32 (not shown). On the outside left in FIG. 2, five supply pumps 44 are shown, one above the other, which can be piston pumps or membrane pumps or any other type of pump suitable for the transport and conveyance of fluids. They are connected by a feed line to the supply lines for feed pumps 10 installed in bracket 12. The use of supply pumps of this type depends on the situation and is advisable in certain cases, such as when the supply tanks for the fluids are distant from the point of use. From the upper part of feed pumps 10, which are advisably double-acting reciprocating pumps here as well, feed lines extend to valves 24, which are mounted on a manifold 26. By means of bracket 12 provided with its five feed pumps 10, preferably paint components are supplied to the manifold on the left, which is preferably designed as a paint manifold 26. From there, a line passes by way of a pressure meter 46 to a valve 24, mounted on a mixer 38. In manifold 26, the fluids collected here, such as paint components, are sent to mixing device 38. Mixing device 38 incorporates a mixer 40, which can be either a static or a dynamic mixer. The two feed pumps 10 mounted in bracket 12, described in FIG. 1 and shown here on the right in FIG. 2, are used in the example shown here to convey and meter curing agent components, which are conveyed from supply tanks by pumps 44 and bracket 12 to feed pumps 10. These curing agent components are supplied to mixing device 38 in a manner similar to that used to supply the paint components. Here, too, discharge lines 22 pass from feed pumps 10 via valves 24 to a manifold 26, which in this case is the curing agent manifold, and from there the components are sent by way of a pressure meter 46 to valve 24 of mixing device 38, the valve being mounted directly on mixing device 38, and are thus introduced into the active mixing area of a mixer 40. Also shown here is a flushing agent pump 42, which can be put into operation if desired either after a change of paint, that is after one feed pump 10 has been replaced by another, or after a change of curing agent, which is also carried out by repositioning feed pumps 10. The flushing liquid which is supplied by flushing agent pump 42 through flushing line 43 by way of valves 24 to the individual manifolds and mixing device components can be a pure cleaning agent or possibly a solvent, which has been selected to suit the consistency and composition of the individual paint and curing agent components.

Figure 3:
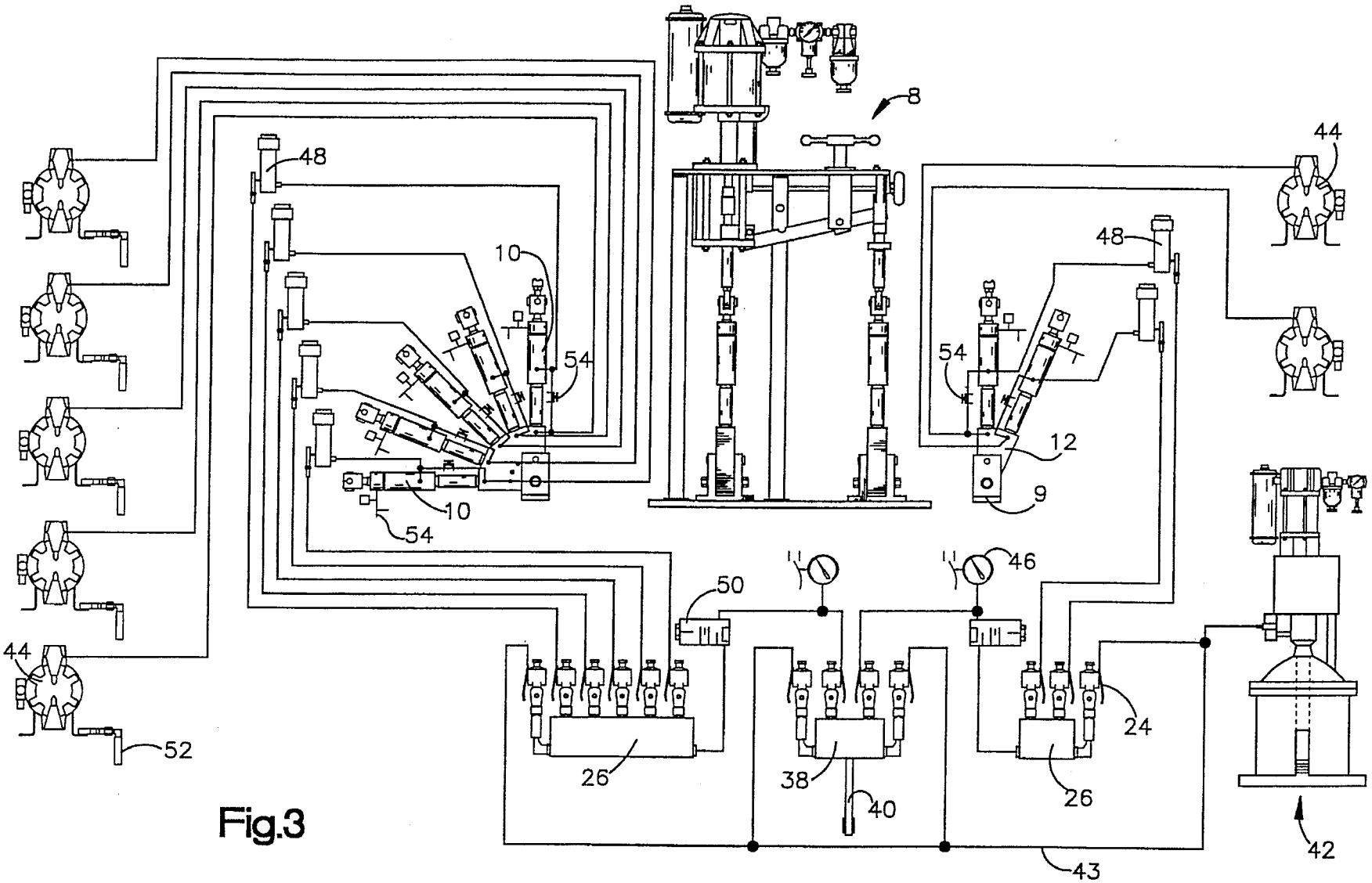
FIG. 3 shows a partial schematic diagram of the system according to FIG. 2, but with additional assemblies and with, in the middle, a variant of the delivery device according to the invention.

Delivery device 8 (as can be seen in FIGS. 1 and 3) is operated by bringing feed pumps 10 into the positions required for delivering the desired components; this principle works in exactly the same way for bracket 12 provided with five feed pumps 10 on the left as it does for bracket 12 shown on the right, the operation of which has been described above. On the left, bores 13 can be seen, which have been made in bracket 12; these bores can accept a latching pin 15, installed in the feed pump in the coupling position. The latching of bracket 12 by means of bore 13 and latching pin 15 facilitates the positioning of feed pumps 10 underneath coupling grip 18 of drive rod 32 (not shown).

Figure 4:
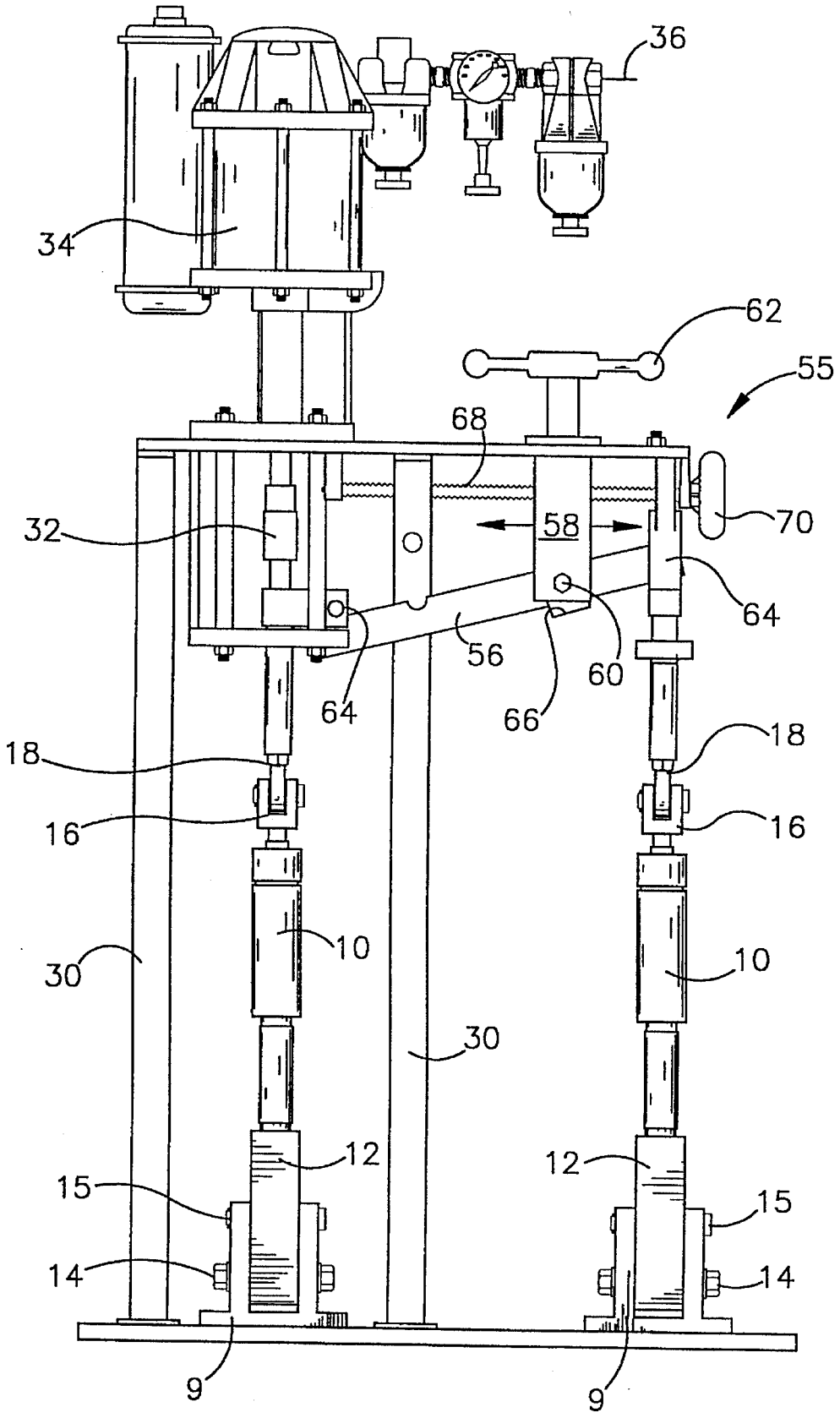
FIG. 4 shows an enlarged view of the delivery device of FIG. 3.

FIG. 3 shows a system very similar to that of FIG. 2, but in this case it is provided with additional units. The delivery device is shown again schematically in the center, and it will be described in detail in conjunction with a discussion of FIG. 4. FIG. 3 serves in fact only to describe the additional units not present in the system shown in FIG. 2. For example, a pressure-relief valve 54 is provided on each feed pump 10 between the feed line and the discharge line. In the upper part of feed pumps 10, pressure-relief valves 54 can also be installed as options. At this point, it is also possible to provide, if desired, a viewing glass for the paint or curing agent components to be conveyed. Between feed pumps 10 and valves 24 of manifolds 26, it is also possible to install optional filters 48 to filter the material being conveyed. Depending on the required processing pressure of a mixture or of one of the components, a pressure controller 50 can be used to set the desired pressure, which can be read on a pressure meter 46. Pressure meters 46 can also be equipped, if desired, with limit value sensors. It is self-evident that similar units can be installed in the lines in the arrangement shown on the right, which can be used effectively to deliver and meter curing agent components. FIG. 3 shows delivery device 8 merely in schematic fashion; the figure shows brackets 12 in use on the left and on the right, with their feed pumps 10, after rotation of the brackets by 90 degrees. The delivery device is described in detail in conjunction with the discussion of FIG. 4. Here it will be assumed that left feed pump 10 represents a feed pump 10 shown on the left in FIG. 3. Right feed pump 10 in FIG. 4 corresponds to one of feed pumps 10 in the arrangement shown on the right in FIG. 3. FIG. 4 shows with particular clarity not only that it is possible to bring about the pure conveyance of fluids to be mixed by the use of only a single drive motor 34, but also that, simultaneously, delivery device 8 can operate right pump 10, which is used here by way of example as a curing agent pump, advantageously as a metering device by way of a lever 56, which is supported in a thrust bearing 60. By means of the metering unit referred to as 55, the ratio of the feed rates between left feed pump 10 and right feed pump 10 can be adjusted. Lever 56, which is supported so that it can rotate on drive rod 32 at hinge point 64, passes through a connecting link 66, in which it is free to slide, and is supported rotatable at another hinge point 64 of a drive rod 32, installed above right feed pump 10. When left hinge point 64 moves down as a result of the downward motion of drive rod 32 of drive motor 34, right hinge point 64 moves up, because lever 56 is turned by way of thrust bearing 60, which is being held stationary at that moment in thrust bearing retainer 58. The mixing ratio, which is determined by the ratio between the piston strokes of the left and right feed pumps, can be derived from the arrangement of thrust bearing 60 between the two hinge points 64. In the example being discussed here, it can be seen that different amounts of a paint component (by way of left feed pump 10) and of a curing agent component (by way of right feed pump 10) are being conveyed. This metering ratio is adjustable, because thrust bearing retainer 58 can be adjusted by rotating threaded spindle 68 back and forth. When threaded spindle 68 is rotated by turning handwheel 70, thrust bearing retainer 58, inside which a nut (not shown) is provided, moves toward the left or toward the right. This is indicated by corresponding arrows. By turning handwheel 62, thrust bearing retainer 58 and its thrust bearing 60 are first released to allow the adjustment of the metering ratio and then locked in place again afterwards.

Figure 5:
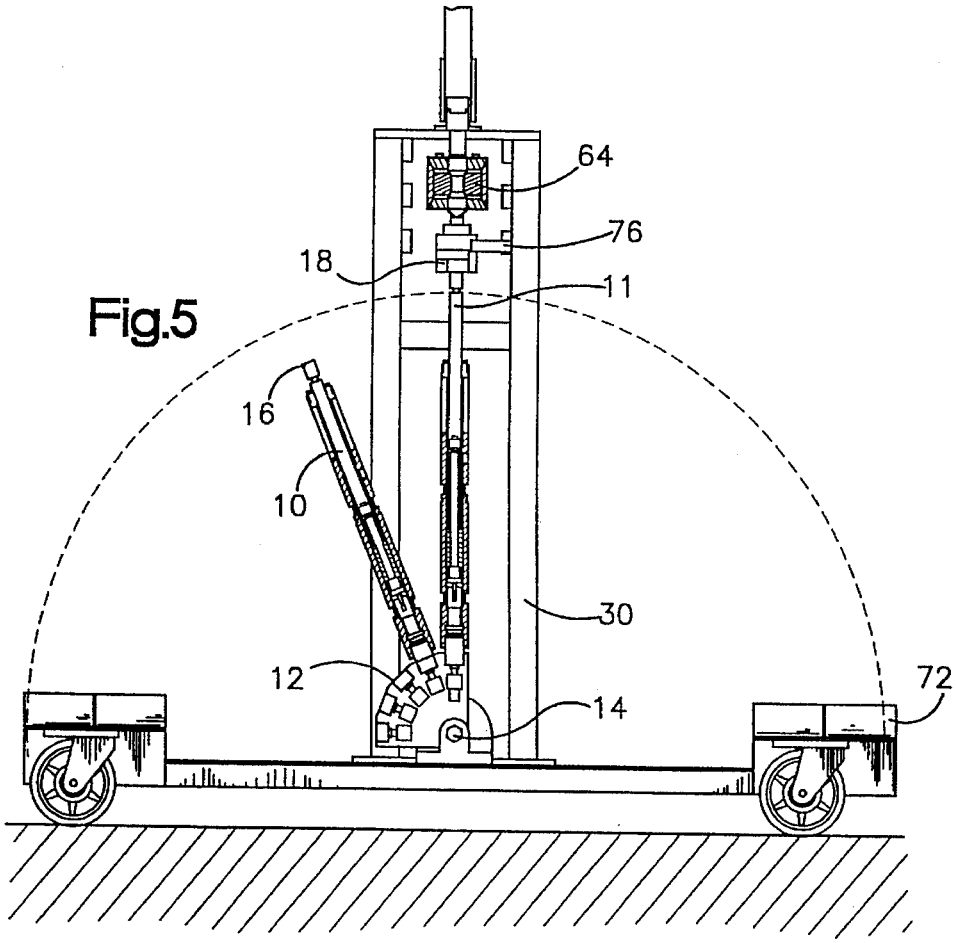
FIG. 5 shows an enlarged, partial view of a rotating bracket with two feed pumps.

FIG. 5 shows an enlarged view of a part of delivery device 8 with an arrangement of two feed pumps 10 for the transport of curing agent shown here by way of example. For feed pump 10 shown in a tilted position, a possible design of a coupling head 16 is shown, which is designed here in the approximate form of a mushroom. In the case of feed pump 10 shown here in the upright position, piston rod 11 has been fully extended upward. With its coupling head 16, it is connected to coupling grip 18. A lever pin 76, which engages with lever 56 at hinge point 64 (not shown), is provided on coupling grip 18. Delivery device 8, only part of which is shown here, stands together with its frame 30 on the bottom of a cart 72.

Figure 6:
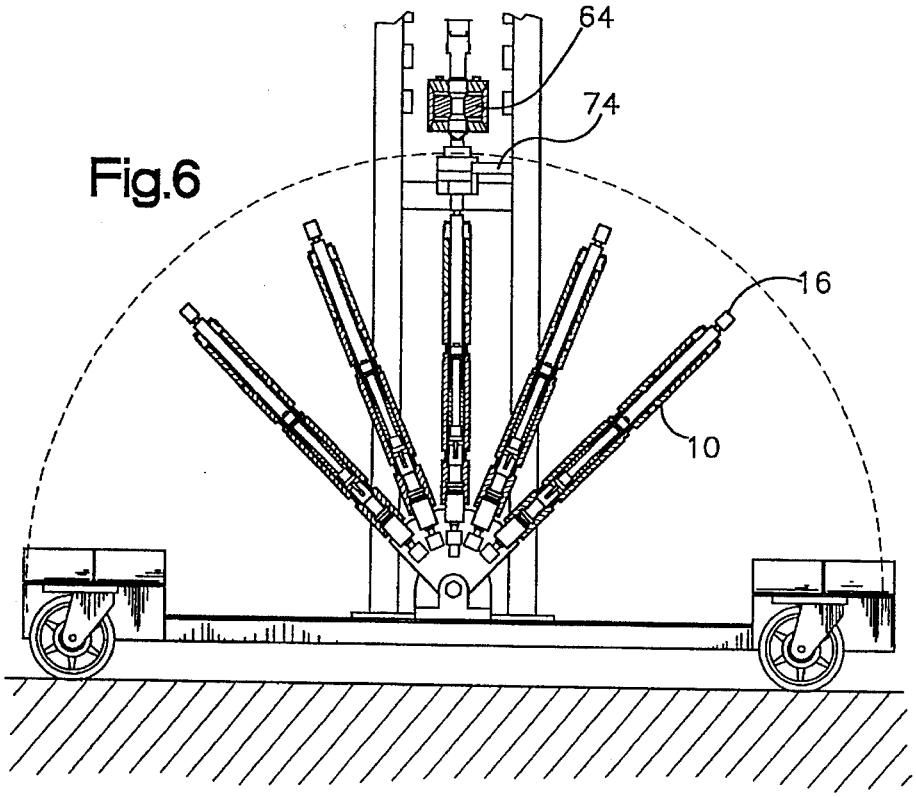
FIG. 6 shows an enlarged, partial view of a bracket with five feed pumps in a star-like configuration.

FIG. 6 shows a configuration similar to that of FIG. 5, but in this case feed pump 10 in the middle is coupled to the drive.

Figure 7:
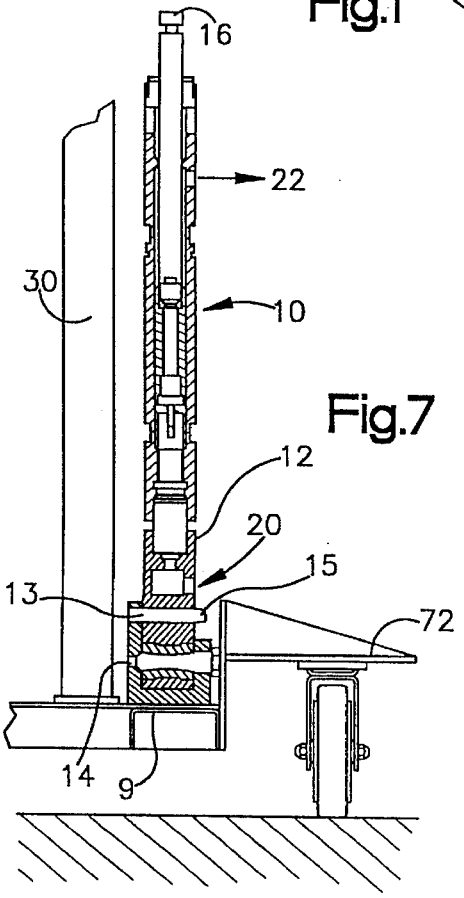
FIG. 7 shows a cross section of a feed pump mounted in a bracket, which is located on a portable base, only part of which is shown.

FIG. 7 shows a magnified view of a feed pump 10 in cross section. It is easy to see here how bearing block 9 is mounted on cart 72. Supported therein is axis of rotation 14, which is supported here by way of example in roller bearings. Above that is a latching pin 15, which fits in a hole 13. Whether latching pin 15 is provided in bearing block 9 so that it can engage in a hole 13 provided in bracket 12 or vice versa can be determined on the basis of which is the more effective way to set up the device. It is easy to see how the lower section of the housing of feed pump 10, i.e., the section which points away from coupling head 16, is mounted in bracket 12. The feed line to feed pump 10 is attached at the point marked 20; this line conveys the appropriate fluid into the feed pump by way of the bottom side of the pump. The discharge line is attached to the feed pump at the point marked 22.

What is claimed is:

1. Device for delivering at least two different fluids to a mixing device where they are to be mixed, the delivery device being provided with a drive with a first coupling and with one feed pump for each of the at least two different fluids, the delivery device characterized in that the feed pumps (10) are adapted to be coupled one at a time to the drive (34) so that only the feed pump coupled to the drive can deliver fluid to the mixing device.

2. Device according to claim 1, wherein each of the feed pumps has a housing and an end, the delivery device characterized in that the feed pumps (10) are mounted on a first bracket (12) having an axis of rotation, the first bracket being rotatable about the axis of rotation, the feed pumps are mounted on the first bracket at the housings so that the ends of the feed pumps point away from the axis of rotation (14) of the bracket and the feed pumps form a star-like pattern.

3. Device according to claim 2 in which the drive has a second coupling like the first coupling, the delivery device characterized by a second rotatable bracket (12) like the first bracket, the device also provided with at least two feed pumps (10) mounted on the second bracket with the feed pump ends pointed away from the axis of rotation of the second bracket so that the feed pumps form a star-like pattern.

4. Device according to claim 3, characterized in that, the device includes a first drive rod connected to the drive, second drive rod, and a transmission for metering the feed rates of the feed pumps, the transmission having a first end connected to the first drive rod, and a second end connected to the second drive rod.

5. Device according to claim 4, characterized in that the transmission is a lever.

6. Device according to claim 4, characterized in that the transmission includes a transmission support member movable along the length of the transmission between the two transmission ends.

7. Device according to claim 3, characterized in that the drive has a reciprocating piston engine (34).

8. Device according to claim 7, characterized in that the reciprocating engine (34) can be operated with compressed air.

9. Device according to claim 3, characterized in that the feed pumps (10) mounted on the first bracket (12) can be used to convey paint components, and in that the feed pumps (10) mounted on the second bracket (12) can be used to convey curing agent components.

10. Device according to claim 9 which includes a paint manifold and a curing agent manifold to collect paints and curing agents respectively for delivery to a mixing device.

* * * * *